US007586512B2

(12) United States Patent
Aoki et al.

(10) Patent No.: US 7,586,512 B2
(45) Date of Patent: Sep. 8, 2009

(54) IMAGE FORMING APPARATUS AND IMAGE DENSITY CONTROLLING METHOD

(75) Inventors: Matsuyuki Aoki, Kanagawa (JP); Satoshi Tanaka, Kanagawa (JP); Nobukazu Takahashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 172 days.

(21) Appl. No.: 11/495,589

(22) Filed: Jul. 31, 2006

(65) Prior Publication Data

US 2007/0165095 A1 Jul. 19, 2007

(30) Foreign Application Priority Data

Jan. 17, 2006 (JP) ..... 2006-008649

(51) Int. Cl.
*B41J 2/435* (2006.01)
*B41J 2/47* (2006.01)

(52) U.S. Cl. ..... 347/254; 347/228

(58) Field of Classification Search ..... 347/133, 347/228, 240, 251–254; 399/27, 254, 272
See application file for complete search history.

(56) References Cited

U.S. PATENT DOCUMENTS 3,881,446 A * 5/1975 Kurita et al. ..... 399/254
6,750,892 B2 * 6/2004 Suzuki ..... 347/133
7,218,871 B2 * 5/2007 Ogata ..... 399/27
7,283,756 B2 * 10/2007 Suzuki ..... 399/27
7,412,194 B2 * 8/2008 Okuda et al. ..... 399/272

FOREIGN PATENT DOCUMENTS

JP B2-2885680 2/1992
JP 09204094 A * 8/1997

* cited by examiner

*Primary Examiner*—Hai C Pham
(74) *Attorney, Agent, or Firm*—Morgan, Lewis & Bockius LLP

(57) ABSTRACT

An image forming apparatus, forming an image by two-dimensionally fast and slow-scanning and exposing with light that has been modulated in accordance with image data representing an image and visualizing an electrostatic latent image with toner, includes a calculating unit that divides an image region in a fast-scanning direction into plural regions and calculates image data amounts to be used for image formation in the image data per each of the plural regions, and a correcting unit that corrects, on the basis of the calculation result of the calculating unit, unevenness of density in the fast-scanning direction in the toner image resulting from a distance between a position where the toner is supplied to a developing roll and a position where the toner is supplied to each of the plural regions.

11 Claims, 11 Drawing Sheets

FIG. 5A

| IMAGE DENSITY (A3-SIZE PAPER) % | IMAGE DATA AMOUNT COUNT |
|---|---|
| 0 | 0 |
| 10 | 1000 |
| 50 | 5000 |
| 100 | 10000 |

FIG. 5B

| REGION NO. | CORRECTION COEFFICIENT |
|---|---|
| 1 | 0 |
| 2 | 0.2 |
| 3 | 0.4 |
| 4 | 0.6 |
| 5 | 0.8 |
| 6 | 1 |

FIG. 5C

| NUMBER OF CONTINUOUS PAGES IN ONE JOB | CORRECTION COEFFICIENT |
|---|---|
| 1~5 | 0 |
| 6~10 | 0.2 |
| 11~20 | 0.5 |
| 21~40 | 0.8 |
| 41~100 | 1 |

FAST-SCANNING DIRECTION DENSITY DECREASE DISTRIBUTION

FAST-SCANNING DIRECTION EXPOSURE AMOUNT CORRECTION DISTRIBUTION

FIG. 8

| REGION | IMAGE DATA AMOUNT COUNT OF EACH REGION | ACCUMULATED IMAGE DATA AMOUNT COUNT OF EACH REGION | CORRECTION COEFFICIENT OF EACH REGION | CORRECTED IMAGE DATA AMOUNT COUNT | DENSITY DECREASE AMOUNT | EXPOSURE AMOUNT INCREASE (%) |
|---|---|---|---|---|---|---|
| 1 | 5000 | 5000 | 0 | 0 | 0 | 0 |
| 2 | 2000 | 7000 | 0.2 | 1400 | 0.0357 | 7.14 |
| 3 | 1000 | 8000 | 0.4 | 3200 | 0.0816 | 16.32 |
| 4 | 500 | 8500 | 0.6 | 5100 | 0.13005 | 26.01 |
| 5 | 0 | 8500 | 0.8 | 6800 | 0.1734 | 34.68 |
| 6 | 0 | 8500 | 1 | 8500 | 0.216775 | 43.35 |
| ALL REGIONS | 8500 | | | | | |

FIG. 9

| REGION | IMAGE DATA AMOUNT COUNT OF EACH REGION | ACCUMULATED IMAGE DATA AMOUNT COUNT OF EACH REGION | CORRECTION COEFFICIENT OF EACH REGION | CORRECTED IMAGE DATA AMOUNT COUNT | DENSITY DECREASE AMOUNT | EXPOSURE AMOUNT INCREASE (%) |
|---|---|---|---|---|---|---|
| 1 | 0 | 0 | 0 | 0 | 0 | 0 |
| 2 | 50 | 50 | 0.2 | 10 | 0.000255 | 0.051 |
| 3 | 200 | 250 | 0.4 | 100 | 0.00255 | 0.51 |
| 4 | 1000 | 1250 | 0.6 | 750 | 0.019125 | 3.825 |
| 5 | 3000 | 4250 | 0.8 | 3400 | 0.0867 | 17.34 |
| 6 | 4000 | 8250 | 1 | 8250 | 0.210375 | 42.075 |
| ALL REGIONS | 8250 | | | | | |

IMAGE FORMING APPARATUS AND IMAGE DENSITY CONTROLLING METHOD

BACKGROUND

1. Technical Field

The present invention relates to an image forming apparatus and an image density controlling method, and in particular to an image forming apparatus that forms an image using toner to form a latent image on a photoconductor that has been exposed in accordance with image data and an image density controlling method for the image forming apparatus.

2. Related Art

Image forming apparatus have image quality requirements, and there have been demands to improve image formation speed and to make such apparatus compact.

As a result of attempts to satisfy such demands, when images with high image density are continuous, it is common for image forming apparatus to be configured such that toner is supplied to developing units from one end in the fast-scanning direction to the other end. For this reason, sometimes there are drawbacks, such as the image forming apparatus becoming unable to maintain uniformity in the supply of the toner in the fast-scanning direction to the developing units, and image density differences in the fast-scanning direction arise.

SUMMARY

According to an aspect of the invention, an image forming apparatus, forming an image by two-dimensionally fast and slow-scanning and exposing with light that has been modulated in accordance with image data representing an image and visualizing an electrostatic latent image with toner, includes a calculating unit that divides an image region in a fast-scanning direction into plural regions and calculates image data amounts to be used for image formation in the image data per each of the plural regions, and a correcting unit that corrects, on the basis of the calculation result of the calculating unit, unevenness of density in the fast-scanning direction in the toner image resulting from a distance between a position where the toner is supplied to a developing roll and a position where the toner is supplied to each of the plural regions.

BRIEF DESCRIPTION OF THE DRAWINGS

An exemplary embodiment of the present invention will be described in detail based on the following figures, wherein:

FIG. 5A is a chart showing an example of counts of image data amounts of an image counting unit;

FIG. 5B is a chart showing an example of correction coefficients for correcting density unevenness in the fast-scanning direction;

FIG. 5C is a chart showing an example of correction coefficients when correcting density unevenness in accordance with numbers of continuous pages in one job;

FIG. 8 is a chart showing an example of image data amount counts, accumulated image data amount counts, correction coefficients, corrected image data amount counts, density decrease amounts, and exposure amount increases in each region;

FIG. 9 is a chart showing another example of image data amount counts, accumulated image data amount counts, correction coefficients, corrected image data amount counts, density decrease amounts, and exposure amount increases in each region;

DETAILED DESCRIPTION

An exemplary embodiment of the present invention will be described in detail below with reference to the drawings.

Figure 1:
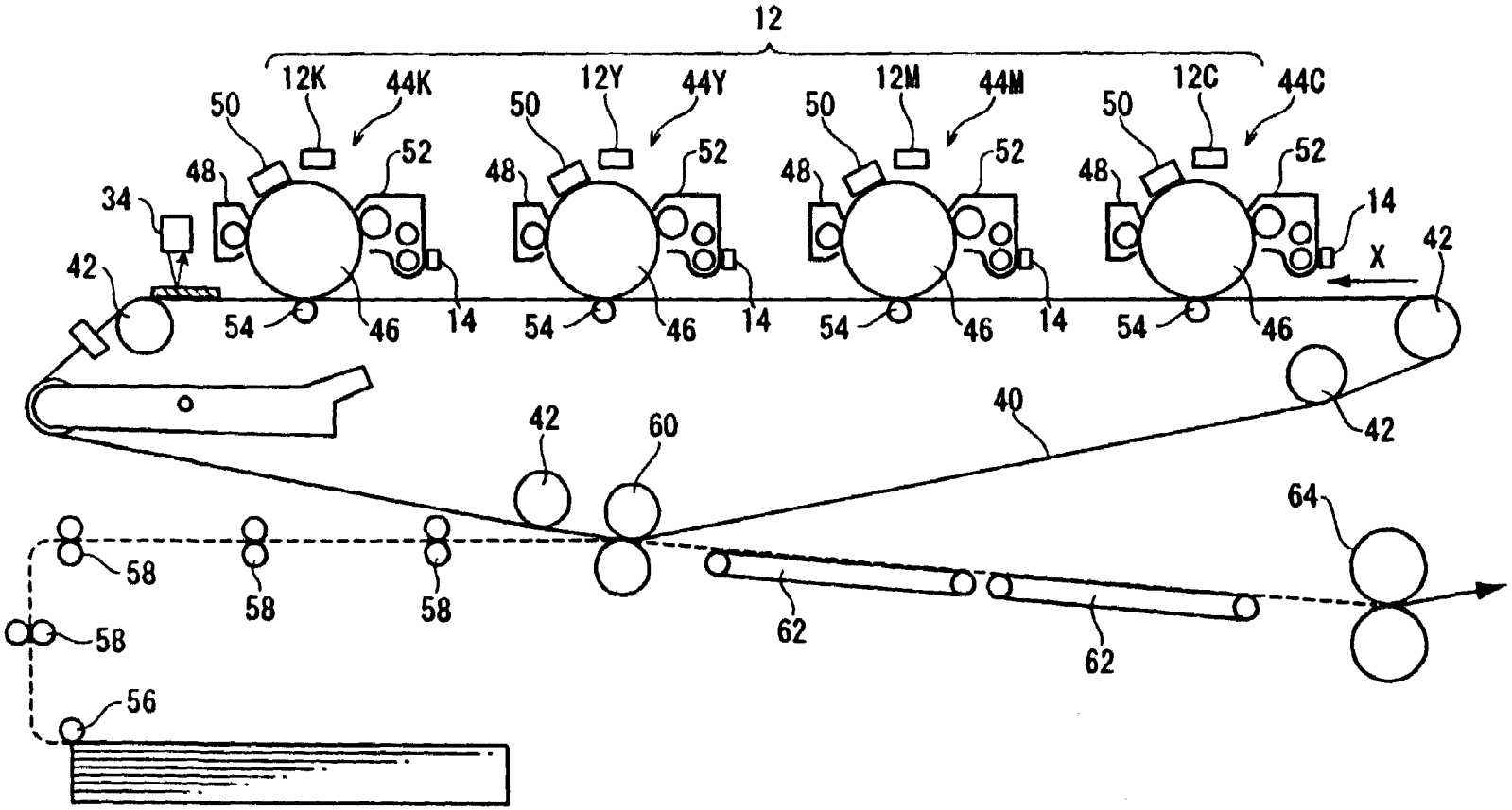
FIG. 1 is a diagram showing the general configuration of a tandem color printer that is applicable to an image forming apparatus pertaining to the exemplary embodiment of the invention.

FIG. 1 is a diagram showing the general configuration of a tandem color printer 10 that is applicable to an image forming apparatus pertaining to the exemplary embodiment of the invention.

As shown in FIG. 1, the tandem color printer 10 includes an intermediate transfer belt 40 that is an endless belt and is supported with a predetermined tension by plural rolls 42. The tandem color printer 10 also includes image recording units 44C, 44M, 44Y and 44K that correspond to the respective colors of cyan (C), magenta (M), yellow (Y), and black (K) and are disposed in order above the intermediate transfer belt 40 along a belt traveling direction X. Unless otherwise noted, reference numerals corresponding to these respective colors will be omitted in the following description because the image recording units 44 all have the same configuration.

Each of the image recording units 44 includes a photoconductor drum 46 that is rotatably supported on an unillustrated apparatus body frame. A cleaner 48, an erase lamp (not shown), a charger 50, a laser scanner 12, a developing unit 52, and a first transfer roll 54 are disposed around each of the photoconductor drums 46 in order along the drum rotational direction (clockwise direction in FIG. 1).

That is, toner remaining on the photoconductor drums 46 is removed by the cleaners 48, and the surfaces of the photoconductor drums 46 are destaticized by the destaticization-use erase lamps, charged by the chargers 50 and irradiated with light by the laser scanners 12 such that latent images are formed on the surfaces of the photoconductor drums 46. Then, toner images are formed by the developing units 52 from the latent images formed by the laser scanners 12, and the toner images are transferred to the intermediate transfer belt 40 by the first transfer rolls 54. It will be noted that slow-scanning is conducted by the photoconductor drums 46 and fast-scanning is conducted is conducted by the laser scanners 12.

The image forming apparatus 10 also includes an auto density control (ADC) sensor 34 that is disposed downstream of the black (K) image recording unit 44K in the belt traveling direction X. The ADC sensor 34 is for detecting the density of the toner images of the respective colors of cyan, magenta, yellow, and black formed on the intermediate transfer belt 40 and conducting feedback of the light amount of the laser scanners 12. It will be noted that the ADC sensor 34 may be a reflective photosensor.

Each of the developing units 52 includes a magnetic permeability sensor (auto toner control sensor, or ATC sensor) 14 for measuring the toner density (=(toner/toner+carrier)×100) of a developing agent and conducting toner supply feedback.

Paper serving as the target of image recording is housed in an unillustrated paper supply cassette, and the paper is removed one sheet at a time by a pickup roll 56 disposed at the side of the paper supply cassette from which the paper is removed. The removed paper is conveyed along a path indicated by the dotted line in FIG. 1 by a predetermined number of roll pairs 58 and is fed to a pressure position of a second transfer roll 60, where the color images formed on the intermediate transfer belt 40 are transferred at once (secondarily transferred) to the paper by the second transfer roll 60. When the color images have been transferred to the paper, the paper is conveyed by paper conveyance systems 62 to a fixer 64, where the images are fixed (by heating and pressure, etc.), and the paper is discharged to an unillustrated tray.

Figure 2B:
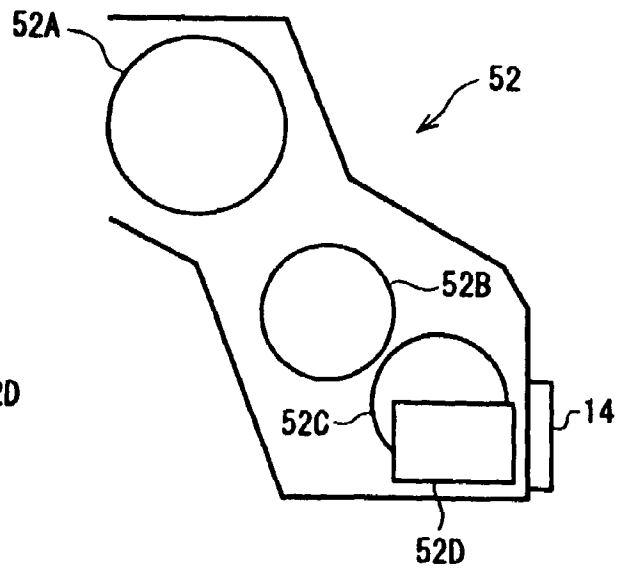
FIG. 2B is a diagram showing the general configuration of a developing unit and the positional relationship between an ADC sensor and an ATC sensor in a fast-scanning direction.
Figure 2A:
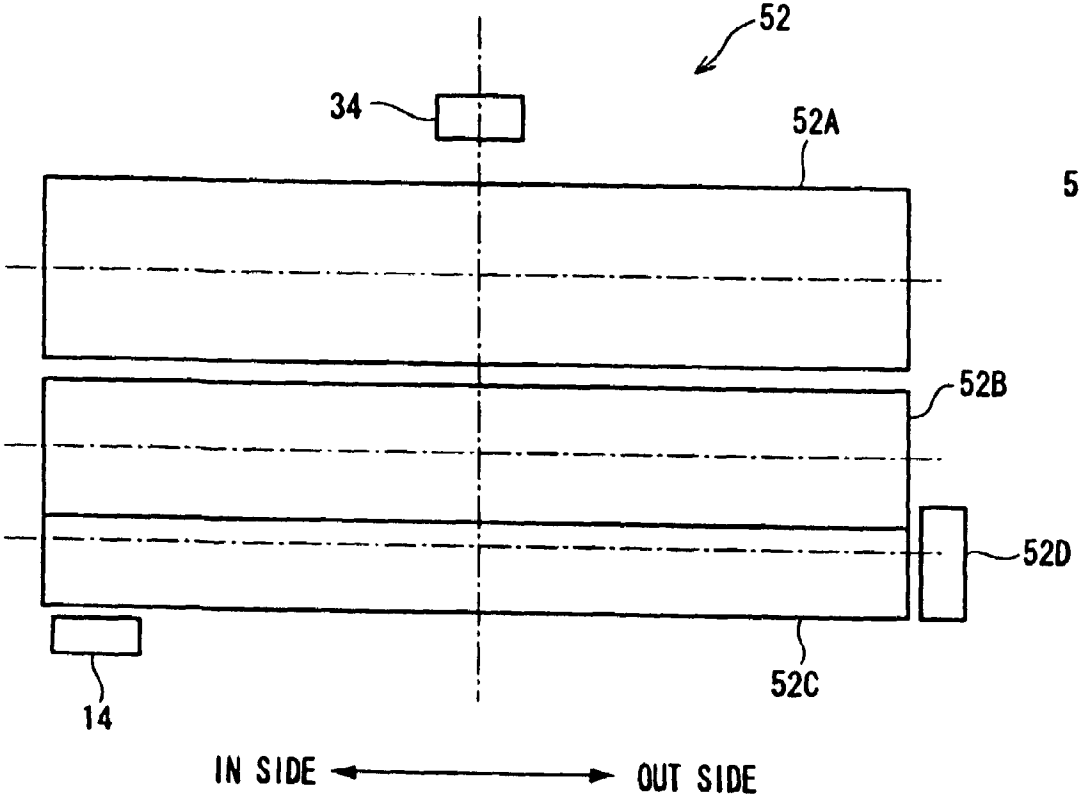
FIG. 2A is a diagram showing the general configuration of a developing unit and the positional relationship between an ADC sensor and an ATC sensor in a fast-scanning direction.

Here, the developing units 52 and the positional relationship between the ADC sensor 34 and the ATC sensors 14 in the fast-scanning direction will be described. FIGS. 2A and 2B are diagrams showing the general configuration of the developing units 52 and the positional relationship between the ADC sensor 34 and the ATC sensors 14 in the fast-scanning direction.

As shown in FIGS. 2A and 2B, each of the developing units 52 includes a developing roll 52A, a supply auger 52B, a stirring auger 52C, a toner supply unit 52D, and the ATC sensor 14.

The toner supply unit 52D is disposed on the fast-scanning direction end portion of the stirring auger 52C. The fast-scanning direction end portion of the stirring auger 52C where the toner supply unit 52D is disposed (below, the fast-scanning direction end portion where the toner supply unit 52D is disposed will be called the OUT side, and the other end portion will be called the IN side) is positioned on the front side of the tandem color printer 10, and the toner is supplied from the toner supply unit 52D by opening and closing an unillustrated door. Specifically, the toner supply unit 52D includes an unillustrated cartridge and is configured such that the toner can be replaced by replacing this cartridge.

The toner supplied from the toner supply unit 52D is conveyed from the OUT side to the IN side while being stirred by the stirring auger 52C and is moved to the supply auger 52B at the IN side. Then, the toner supplied from the supply auger 52B is supplied to the developing roll 52A.

In the present exemplary embodiment, since the toner supply amount is reduced at the moment the toner reaches the OUT side because the toner is supplied to the developing roll 52A from the IN side to the OUT side, the ATC sensor 14 is disposed at the IN side of the stirring auger 52C in order to properly control the toner supply amount. In contrast, the ADC sensor 34 is disposed in the substantial center of the fast-scanning direction in order to detect a patch image formed on the intermediate transfer belt 40.

Figure 3:
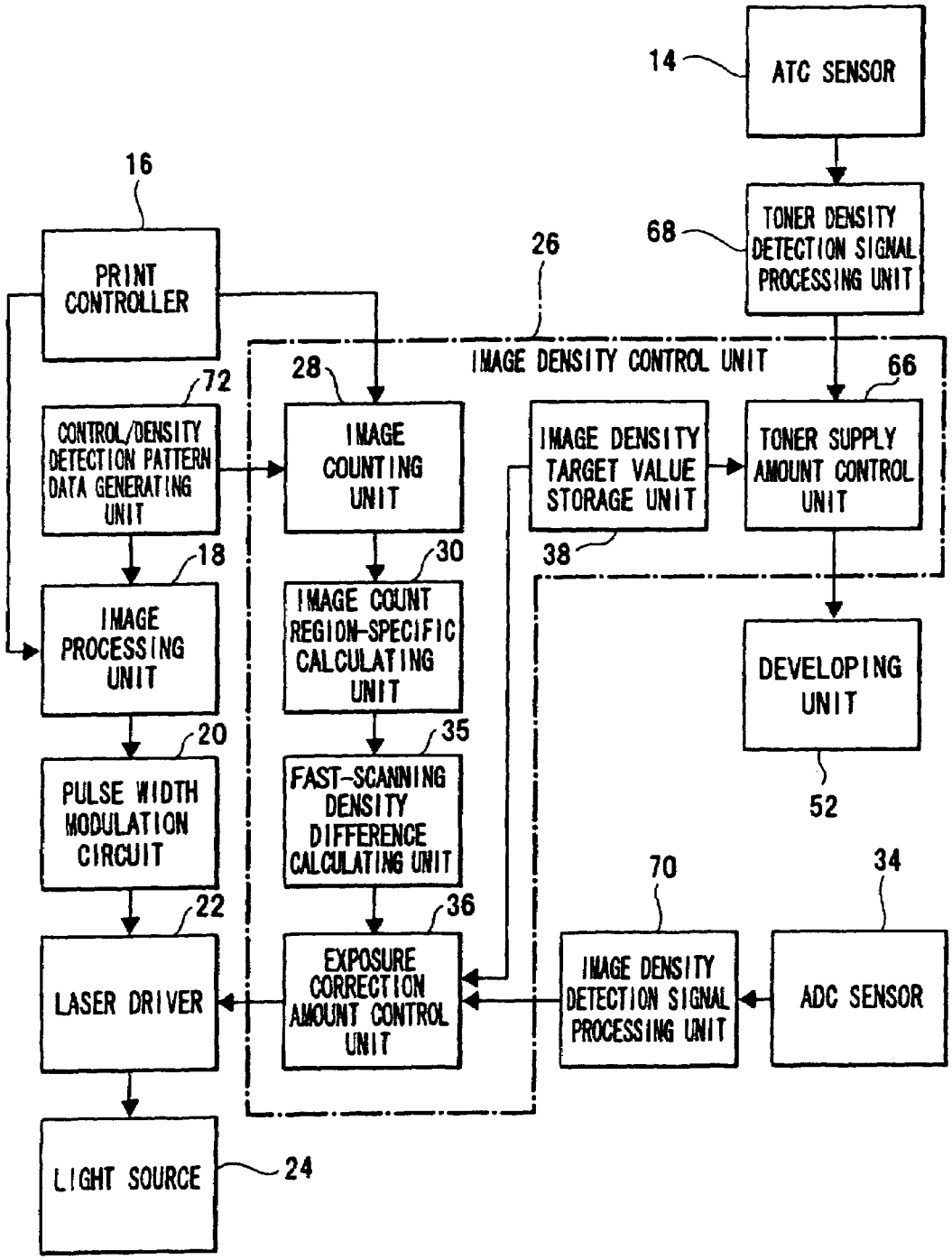
FIG. 3 is a block diagram showing the configuration of a control system of the tandem color printer pertaining to the exemplary embodiment of the invention.

Next, the configuration of a control system of the tandem color printer 10 pertaining to the exemplary embodiment of the invention will be described. FIG. 3 is a block diagram showing the configuration of the control system of the tandem color printer 10 pertaining to the exemplary embodiment of the invention.

The entire tandem color printer 10 pertaining to the present exemplary embodiment is controlled by a print controller 16, and image data from which an image is to be formed is inputted to the print controller 16.

Further, the tandem color printer 10 includes an image processing unit 18, a pulse width modulation circuit 20, a laser driver 22, and a laser light source 24. The formation of images on the photoconductor drums 46 is conducted by these.

When image data is inputted to the print controller 16, the image data is outputted to the image processing unit 18, where the image data undergoes predetermined image processing, and is then outputted to the pulse width modulation circuit 20.

In the pulse width modulation circuit 20, modulation data for emitting modulated light corresponding to the image data is generated and outputted to the laser driver 22.

The laser driver 22 drives the laser light source 24 on the basis of the modulation data and scans and exposes the photoconductor drums 46. Thus, scanning and exposure are conducted in the fast-scanning direction on the photoconductor drums 46, slow-scanning is conducted by the rotation of the photoconductor drums 46, and images are formed on the photoconductor drums 46.

As mentioned above, because the tandem color printer 10 pertaining to the present exemplary embodiment is configured such that the toner is supplied to the developing rolls 52A from the IN side to the OUT side, there is a tendency for the toner supply amount at the OUT side to become reduced such that density differences in the fast-scanning direction arise. For this reason, the tandem color printer 10 is configured to prevent density differences in the fast-scanning direction by conducting density control, and this density control is conducted by an image density control unit 26.

The image density control unit 26 includes an image counting unit 28, an image count region-specific calculating unit 30, a fast-scanning density difference calculating unit 35, an exposure correction amount control unit 36, a toner supply amount control unit 66, and an image density target value storage unit 38.

The image counting unit 28 inputs the image data from the print controller 16 and counts the image data amount. For example, the image counting unit 28 calculates, as the image data amount, the number of effective signals with which an image is to be formed in the image data. It will be noted that the counting of the image data amount is conducted by counting, in the smallest unit of the image data, the image data amount with which an image is to be formed, or by counting the accumulation of image data amounts with which an image is to be formed in one job. For example, as shown in FIG. 5A, the image data amount can be counted such that when the image data has an image density of 0% on A3-size paper, then the count is 0. When the image data has an image density of 10%, then the count is 1000. When the image data has an image density of 50%, then the count is 5000. And when the image has an image density of 100%, then the count is 10,000.

Figure 4:
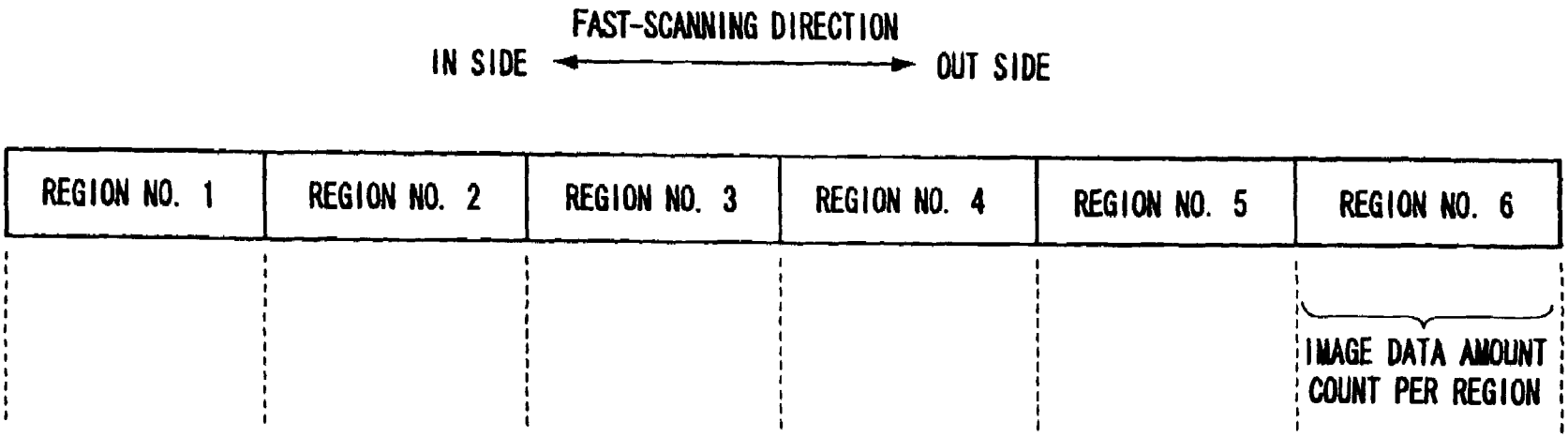
FIG. 4 is a diagram showing an example where the fast-scanning direction is divided into plural regions.

As shown in FIG. 4, the image count region-specific calculating unit 30 divides the fast-scanning direction into plural regions and calculates the image data amount per region. In the present exemplary embodiment, the fast-scanning direction is divided into six regions having region nos. 1 to 6, and the image data amount per region is calculated.

The fast-scanning density difference calculating unit 35 calculates the density difference in the fast-scanning direction by calculating the corrected image data amount count per region (image data amount corresponding to the amount of toner consumed per region at the time of toner supply) using a predetermined correction coefficient per region (region nos. 1 to 6) and calculating the density decrease amount per region corresponding to the calculated corrected image data amount count. In the present exemplary embodiment, the correction coefficients are set such that they become larger in order from region no. 1 to region no. 6 in consideration of toner consumption at the time of supply because the toner is supplied to the developing rolls 52A from the IN side to the OUT side. An example of the correction coefficients is shown in FIG. 5B.

Figure 6A:
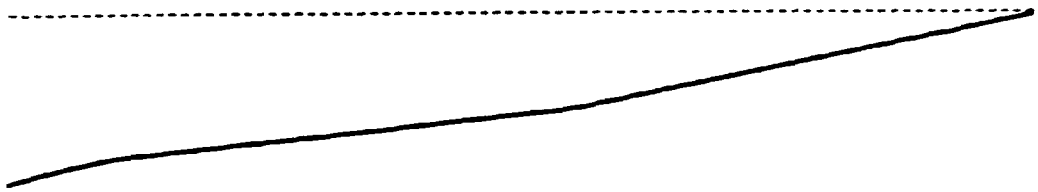
FIG. 6A is a diagram showing an example of a density decrease distribution in the fast-scanning direction.
Figure 6A:
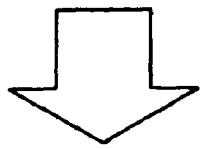
Figure 6B:
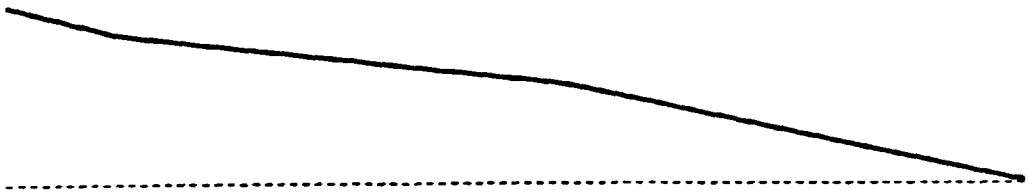
FIG. 6B is a diagram showing an example of a fast-scanning direction exposure amount correction distribution.

The exposure correction amount control unit 36 calculates the exposure amount increase distribution and controls the laser driver 22 in accordance with the calculation result by calculating the exposure amount increase per region from the density decrease amount per region calculated by the fast-scanning density difference calculating unit 35. That is, the exposure correction amount control unit 36 controls density unevenness in the fast-scanning direction resulting from the distance from the position where the toner is supplied to the developing rolls 52A to each region by controlling the exposure amount. Specifically, the density decrease distribution in the fast-scanning direction becomes as shown in FIG. 6A because the toner is supplied to the developing rolls 52A from the IN side to the OUT side. In order to eliminate this, a fast-scanning direction exposure amount correction (increase) distribution is generated as shown in FIG. 6B, and the exposure correction amount control unit 36 controls the laser driver 22, whereby density unevenness in the fast-scanning direction resulting from the distance from the position where the toner is supplied to the developing rolls 52A to each region is controlled.

The toner supply amount control unit 66 detects the toner density with the ATC sensors 14 disposed in the developing units 52 and controls the toner supply amount.

The detection results of the ATC sensors 14 are inputted to the toner supply amount control unit 66 after predetermined signal processing is conducted by a toner density detection signal processing unit 68.

The image density target value storage unit 38 stores a target value of toner density for controlling the toner supply detected by the ATC sensors 14 and a target value of the patch image detected by the ADC sensor 34.

Moreover, the tandem color printer 10 pertaining to the present exemplary embodiment includes a control/density detection pattern data generating unit 72. Pattern data for detecting the density of the toner image of each color is generated, the patch image is generated on the intermediate transfer belt 40 on the basis of the pattern data generated by the control/density detection pattern data generating unit 72, and the density of the patch image is detected by the ADC sensor 34.

When the density of the patch image is detected by the ADC sensor 34, the detection result of the ADC sensor 34 is outputted to the exposure correction amount control unit 36 after predetermined signal processing is administered thereto by an image density detection signal processing unit 70. Then, in the exposure correction amount control unit 36, the target value of the density of the patch image stored in the image density target value storage unit 38 and the density of the detection result of the ADC sensor 34 are compared and density control is conducted.

Next, an example of the operation conducted by the tandem color printer 10 pertaining to the exemplary embodiment of the present invention configured as described above will be described.

Figure 7:
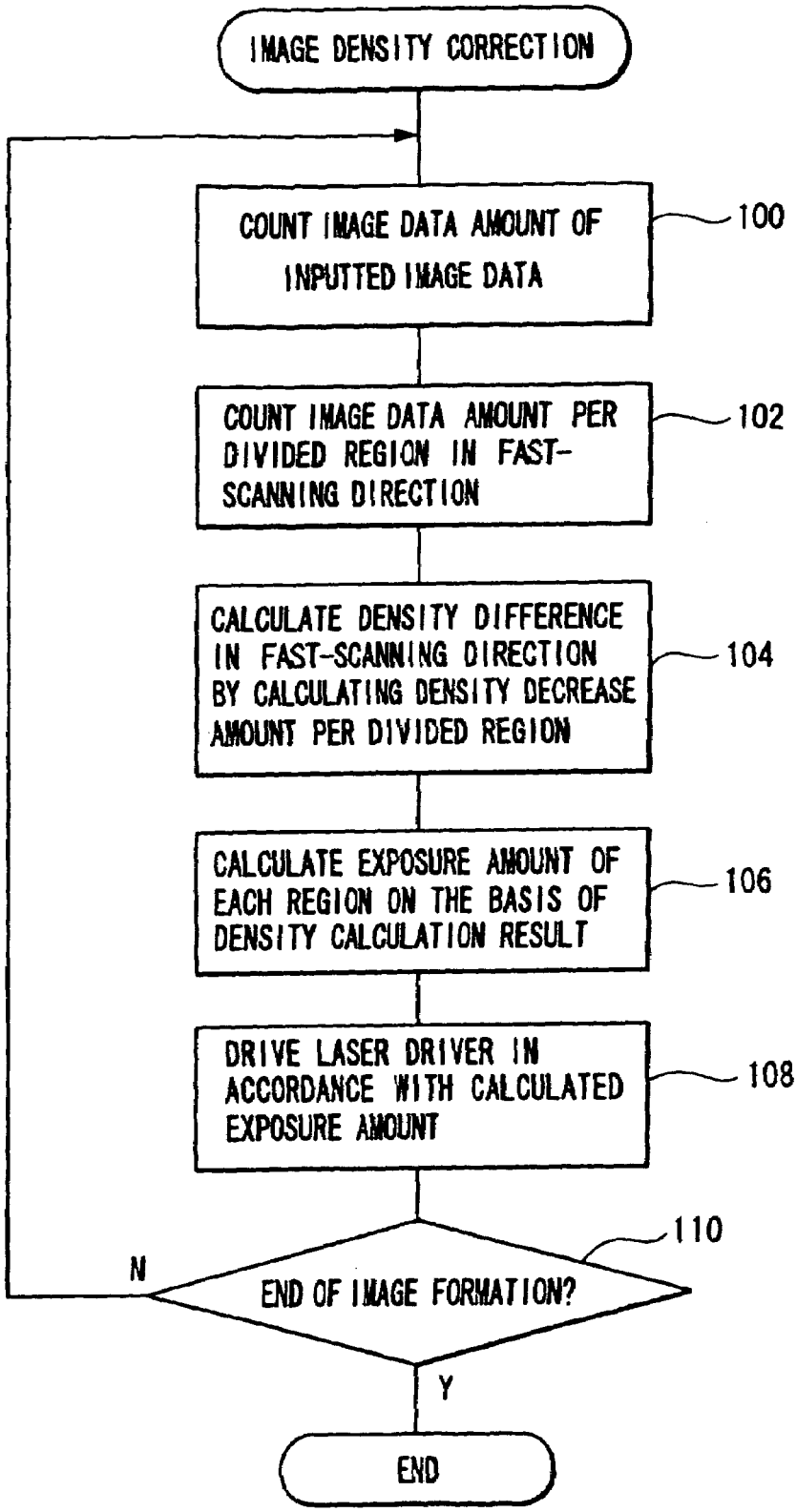
FIG. 7 is a flowchart showing an example of the flow of image density correction that is conducted by an image density control unit at the time of image formation.

First, image density correction in the fast-scanning direction conducted at the time of image formation will be described. FIG. 7 is a flowchart showing an example of the flow of the image density correction conducted by the image density control unit 26 at the time of image formation.

When image data is inputted to the print controller 16, first, in step 100, the image data amount of the inputted image data is counted by the image counting unit 28. Then, the flow moves to step 102.

In step 102, the image data amount per region in the fast-scanning direction is calculated by the image count region-specific calculating unit 30. Then, the flow moves to step 104. The image data amount of each region is counted as shown in FIG. 8, for example. In the case of FIG. 8, the image data amount count of region no. 1 is 5,000, the image data amount count of region no. 2 is 2,000, the image data amount count of region no. 3 is 1,000, the image data amount count of region no. 4 is 500, the image data amount count of region no. 5 is 0, and the image data amount count of region no. 6 is 0.

In step 104, the density difference in the fast-scanning direction is calculated by the fast-scanning density difference calculating unit 35 by calculating the density decrease amount per region. Specifically, the fast-scanning density difference calculating unit 35 calculates the density difference in the fast-scanning direction by calculating the accumulated image data amount count of each region, using the predetermined correction coefficients per region to calculate the corrected image data amount count corresponding to the amount of toner consumed per region at the time of toner supply, and calculating the density decrease amount corresponding to the corrected image data amount count. For example, in the case of FIG. 8, the accumulated image data amount count of region no. 1 is 5,000, the accumulated image data amount count of region no. 2 is 7,000 as a result of the image data amounts of region no. 1 and region no. 2 being accumulated, the accumulated image data amount count of region no. 3 is 8,000 as a result of the image data amounts of region nos. 1 to 3 being accumulated, the accumulated image data amount count of region no. 4 is 8,500 as a result of the image data amounts of region nos. 1 to 4 being accumulated, the accumulated image data amount count of region no. 5 is 8,500 as a result of the image data amounts of region nos. 1 to 5 being accumulated, and the accumulated image data amount count of region no. 6 is 8,500 as a result of the image data amounts of region nos. 1 to 6 being accumulated. Further, assuming that the predetermined correction coefficients (FIG. 5B) are such that the correction coefficient of region no. 1 is 0, the correction coefficient of region no. 2 is 0.2, the correction coefficient of region no. 3 is 0.4, the correction coefficient of region no. 4 is 0.6, the correction coefficient of region no. 5 is 0.8, and the correction coefficient of region no. 6 is 1, then the correction coefficients are multiplied by the accumulated image data amount counts per region so that the corrected image data amount count of region no. 1 becomes 0, the corrected image data amount count of region no. 2 becomes 1,400, the corrected image data amount count of region no. 3 becomes 3,200, the corrected image data amount count of region no. 4 becomes 5,100, the corrected image data amount count of region no. 5 becomes 6,800, and the corrected image data amount count of region no. 6 becomes 8,500. Then, based on the fact that there is a density decrease amount of 0.3 (predetermined value) in an image data amount of 10,000, the density decrease amount of region no. 1 becomes 0, the density decrease amount of region no. 2 becomes 0.0357, the density decrease amount of region no. 3 becomes 0.0816, the density decrease amount of region no. 4 becomes 0.13005, the density decrease amount of region no. 5 becomes 0.1734, and the density decrease amount of region no. 6 becomes 0.216775.

Next, in step 106, the exposure correction amount per region (exposure amount increase distribution) is calculated by the exposure correction amount control unit 36 on the basis of the density calculation results. Then, the flow moves to step 108, where the laser driver 22 is driven by the exposure correction amount control unit 36 in accordance with the calculated exposure correction amounts. Then, the flow moves to step 110. For example, assuming that the exposure correction amount of each region (exposure amount increase) in the case of FIG. 8 corresponds to an exposure amount of 2% per density decrease of Δ0.01, then the exposure correction amount of region no. 1 becomes 0, the exposure correction amount of region no. 2 becomes 7.14, the exposure correction amount of region no. 3 becomes 16.32, the exposure correction amount of region no. 4 becomes 26.01, the exposure correction amount of region no. 5 becomes 34.68, and the exposure correction amount of region no. 6 becomes 43.35. It will be noted that the exposure amounts may also be further corrected in accordance with the number of continuous pages in one job (e.g., number of continuous pages of the same image, etc.). In this case, for example, as shown in FIG. 5C, the correction coefficient becomes 0 when the number of continuous pages is 1 to 5, the correction coefficient becomes 0.2 when the number of continuous pages is 6 to 10, the correction coefficient becomes 0.5 when the number of continuous pages is 11 to 20, the correction coefficient becomes 0.8 when the number of continuous pages is 21 to 40, and the correction coefficient becomes 1 when the number of continuous pages is 41 to 100. By multiplying each of the above correction coefficients by the calculated exposure amount increases per region, it becomes possible for correction to be conducted in consideration of the number of continuous pages in one job.

In step 110, whether or not image formation has ended is determined by the image density control unit 26. This determination is done by determining whether or not there is image data to be inputted from the print controller 16. When the determination is NO, then the flow returns to step 100 and the above-described processing is repeated. The series of processing ends when the determination in step 110 is YES.

Here, the aforementioned image density correction will be described using an example (FIG. 9) other than FIG. 8.

The image data amount of the image data is calculated by the image counting unit 28, and the image data amount per region is calculated by the image count region-specific calculating unit 30. In the case of FIG. 9, the image data amount count of region no. 1 is 0, the image data amount count of region no. 2 is 50, the image data amount count of region no. 3 is 200, the image data amount count of region no. 4 is 1,000, the image data amount count of region no. 5 is 3,000, and the image data amount count of region no. 6 is 4,000.

Next, the accumulated image data amount count of each region is calculated. In the case of FIG. 9, the accumulated image data amount count of region no. 1 is 0, the accumulated image data amount count of region no. 2 is 50 as a result of the image data amounts of region no. 1 and region no. 2 being accumulated, the accumulated image data amount count of region no. 3 is 250 as a result of the image data amounts of region nos. 1 to 3 being accumulated, the accumulated image data amount count of region no. 4 is 1,250 as a result of the image data amounts of region nos. 1 to 4 being accumulated, the accumulated image data amount count of region no. 5 is 4,250 as a result of the image data amounts of region nos. 1 to 5 being accumulated, and the accumulated image data amount count of region no. 6 is 8,250 as a result of the image data amounts of region nos. 1 to 6 being accumulated.

Further, with respect to the predetermined correction coefficients (FIG. 5B), similar to what was described above, the correction coefficient of region no. 1 is 0, the correction coefficient of region no. 2 is 0.2, the correction coefficient of region no. 3 is 0.4, the correction coefficient of region no. 4 is 0.6, the correction coefficient of region no. 5 is 0.8, and the correction coefficient of region no. 6 is 1. The correction coefficients are multiplied by the accumulated image data amount counts such that the corrected image data amount counts are calculated. In the case of FIG. 9, the corrected image data amount count of region no. 1 is 0, the corrected image data amount count of region no. 2 is 10, the corrected image data amount count of region no. 3 is 100, the corrected image data amount count of region no. 4 is 750, the corrected image data amount count of region no. 5 is 3,400, and the corrected image data amount count of region no. 6 is 8,250.

Then, the density decrease amounts are calculated from the corrected image data amount counts. In the case of FIG. 9, the density decrease amount of region no. 1 becomes 0, the density decrease amount of region no. 2 becomes 0.000255, the density decrease amount of region no. 3 becomes 0.00255, the density decrease amount of region no. 4 becomes 0.019125, the density decrease amount of region no. 5 becomes 0.0867, and the density decrease amount of region no. 6 becomes 0.210375. It will be noted that, similar to what was described above, the fact that there is a density decrease amount of 0.3 (predetermined value) in an image data amount of 10,000 serves as the basis for calculating the density decrease amounts.

Finally, the exposure amount increases are calculated from the density decrease amounts. In the case of FIG. 9, the exposure amount increase of region no. 1 becomes 0, the exposure amount increase of region no. 2 becomes 0.051, the exposure amount increase of region no. 3 becomes 0.51, the exposure amount increase of region no. 4 becomes 3.825, the exposure amount increase of region no. 5 becomes 17.34, and the exposure amount increase of region no. 6 becomes 42.075. It will be noted that, similar to what was described above, the exposure amount increases are calculated as an exposure amount of 2% per density decrease of Δ0.01.

In this manner, in the present exemplary embodiment, the fast-scanning direction is plurally divided, the image data amount of each region is calculated, the predetermined correction coefficients are used per region, the corrected image data amount counts corresponding to the amount of toner consumed per region at the time of toner supply are calculated, the density decrease amounts of each region are calculated from the calculated corrected image data amount counts, and the exposure amounts for correcting the densities corresponding to the calculated density decrease amounts are calculated to correct the exposure amounts.

Next, image density control that is conducted at a predetermined timing and forms the patch image and controls image density will be described.

Figure 10:
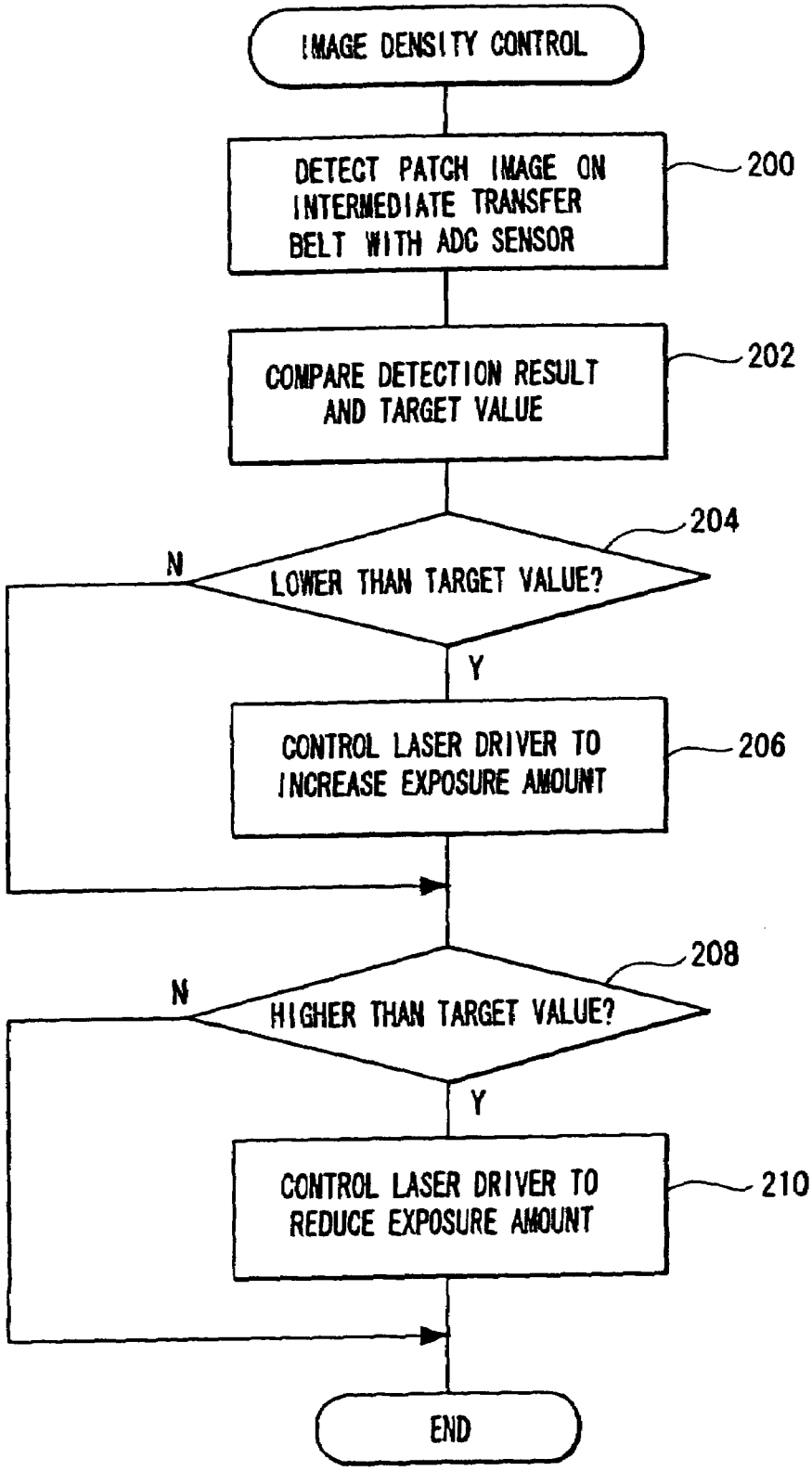
FIG. 10 is a flowchart showing an example of the flow of image density control that is conducted by an exposure correction amount control unit.

The image density control forms the patch image at a predetermined timing on the intermediate transfer belt 40, detects the density of the patch image, and conducts control such that the detection result becomes a target density. FIG. 10 is a flowchart showing an example of the flow of the image density control conducted by the exposure correction amount control unit 36. It will be noted that the image density control starts at a predetermined timing (e.g., when the apparatus is started, or at a time when an image is not to be formed, etc.).

In step 200, the patch image formed on the intermediate transfer belt 40 on the basis of the pattern data representing the patch image generated by the control/density detection pattern data generating unit 72 is detected by the ADC sensor 34. Then, the flow moves to step 202. That is, the detection result of the ADC sensor 34 is inputted to the exposure correction amount control unit 36 after predetermined signal processing is conducted by the image density detection signal processing unit 70.

In step 202, the detection result of the ADC sensor 34 that has been signal-processed and the target value stored in the image density target value storage unit 38 are compared by the exposure correction amount control unit 36.

Next, in step 204, whether or not the density of the patch image is lower than the target value is determined by the exposure correction amount control unit 36 from the comparison result of step 202. When the determination is YES, then the flow moves to step 206. When the determination is NO, then the flow moves to step 208. It will be noted that the determination in step 204 is conducted by determining whether or not the density is substantially Δ0.05 lower than the target value, for example.

In step 206, the laser driver 22 is controlled by the exposure correction amount control unit 36 to increase the exposure amount. Then, the flow moves to step 208.

In step 208, whether or not the density of the patch image is higher than the target value is determined by the exposure correction amount control unit 36 from the comparison result of step 202. When the determination is YES, then the flow moves to step 210. When the determination is NO, then the image density control ends. It will be noted that the determination in step 208 is conducted by determining whether or not the density is substantially Δ0.05 higher than the target value, for example.

In step 210, the laser driver 22 is controlled by the exposure correction amount control unit 36 to reduce the exposure amount. Then, the series of processing ends.

In this manner, stable image formation becomes possible by controlling the exposure amount such that the density of the patch image becomes a predetermined target value.

Figure 11:
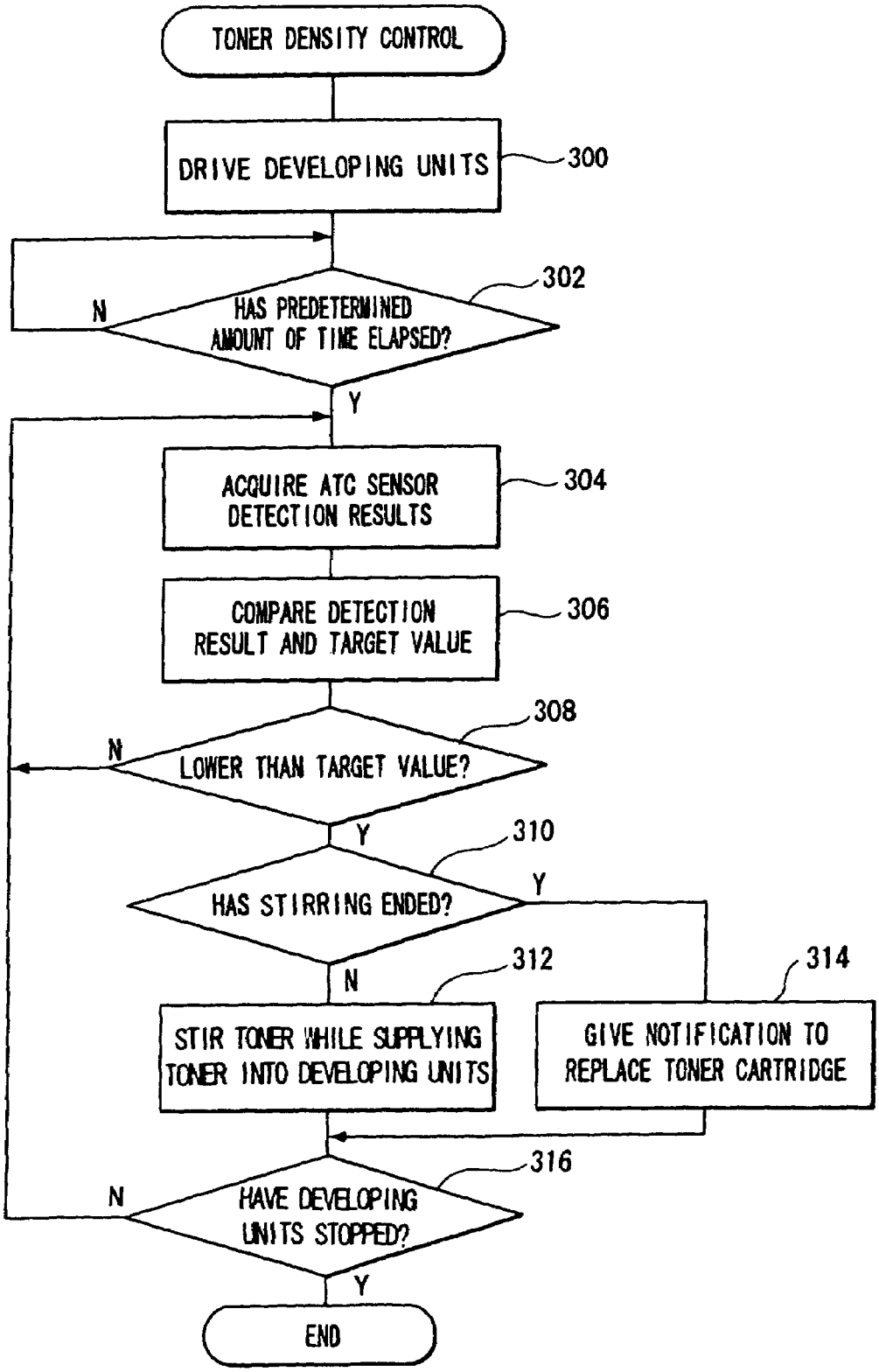
FIG. 11 is a flowchart showing an example of the flow of toner density control that is conducted by a toner supply amount control unit.

Next, control pertaining to image density that is conducted by controlling the toner supply and stirring for the developing units 52 will be described. FIG. 11 is a flowchart showing an example of the flow of the toner density control conducted by the toner supply amount control unit 66.

In step 300, the developing units 52 are driven by the toner supply amount control unit 66. Then, the flow moves to step 302. The toner supply amount control unit 66 drives the developing units 52 at a timing when image data is inputted to the print controller 16, for example.

In step 302, whether or not a predetermined amount of time has elapsed is determined by the toner supply amount control unit 66. This determination is done by determining whether or not an amount of time (e.g., 1 sec) until the developing agent inside the developing units 52 is stable has elapsed. The toner supply amount control unit 66 stands by until this determination becomes YES, and then the flow moves to step 304.

In step 304, the detection results of the ATC sensors 14 are acquired by the toner supply amount control unit 66. That is, the detection results of the ATC sensors 14 are inputted to the toner supply amount control unit 66 after predetermined signal processing has been administered thereto by the toner density detection signal processing unit 68.

In step 306, the detection results of the ATC sensors 14 that have been signal-processed and the target value stored in the image density target value storage unit 38 are compared by the toner supply amount control unit 66. Then, the flow moves to step 308.

In step 308, whether or not the toner density inside the developing units 52 is lower than the target value is determined by the toner supply amount control unit 66 from the comparison result in step 306. When the determination is NO, then the flow returns to step 304 and the above-described processing is repeated. When the determination is YES, then the flow moves to step 310. It will be noted that the determination in step 308 is conducted by determining whether or not the toner density weight ratio is substantially Δ0.2% lower than the target value, for example.

In step 310, whether or not the toner has already been stirred in the developing units 52 is determined by the toner supply amount control unit 66. When the determination is NO, then the flow moves to step 312. When the determination is YES, then the flow moves to step 314.

In step 312, the toner is stirred inside the developing units 52 while being supplied by the toner supply amount control unit 66. Then, the flow moves to step 316. That is, the toner supply units 52D are controlled by the toner supply amount control unit 66 such that the toner is supplied, and the developing units 52 are controlled by the toner supply amount control unit 66 such that the stirring augers 52C rotate and stir the toner.

In step 314, the toner density is lower than the target value even if toner supply and toner stirring are conducted. Thus, the toner supply amount control unit 66 conducts control such that a message or the like prompting toner cartridge replacement is displayed on an unillustrated display unit, whereby notification is given to replace the toner cartridge. Then, the flow moves to step 316.

In step 316, whether or not the developing units 52 have stopped is determined by the toner supply amount control unit 66. For example, the determination is YES and the series of toner density control ends when the formation of all images corresponding to the image data inputted to the print controller 16 ends or when an instruction for the apparatus to stop image formation has been given. When the determination is NO, then the flow returns to step 304 and the above-described processing is repeated.

That is, in the tandem color printer 10 pertaining to the present exemplary embodiment, when the toner density inside the developing units 52 is lower than a target value, the toner is stirred to stabilize the toner density and the toner is supplied inside the developing units 52 to stabilize the toner density.

It will be noted that the toner density control of the tandem color printer 10 pertaining to the preceding exemplary embodiment is configured such that the toner is stirred while the toner is supplied when the toner density is lower than the target value. However, the toner density control may also be configured such that just toner stirring is conducted, or such that just toner supply is conducted, or such that the toner is supplied inside the developing units 52 when the toner density inside the developing units 52 is low after stirring has been conducted.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus that forms an image by two-dimensionally fast and slow-scanning and exposing with light that has been modulated in accordance with image data representing an image and visualizing an electrostatic latent image with toner, the apparatus comprising:

a calculating unit that divides an image region in a fast-scanning direction into a plurality of regions and calculates image data amounts to be used for image formation in the image data per each of the plurality of regions; and a correcting unit that corrects, on the basis of the calculation result of the calculating unit and each of correction coefficients in consideration of a distance between a position where the toner is supplied to a developing roll and a position where the toner is supplied to each of the plurality of regions, unevenness of density in the fast-scanning direction in the toner image, wherein the correcting unit includes a density decrease calculating unit that calculates, from the calculation result of the calculating unit and each of the correction coefficients, a density decrease distribution in the fast-scanning direction of the toner image, and wherein the density decrease calculating unit calculates corrected image data amount counts per each of the plurality of regions by using the correction coefficients per each of the plurality of regions and calculates the density decrease distribution in accordance with the corrected image data amount counts.

2. The image forming apparatus of claim 1, wherein the correcting unit further includes an exposure amount calculating unit that calculates an exposure amount increase distribution corresponding to the calculation result of the density decrease calculating unit, and an exposure control unit that controls exposure amounts on the basis of the calculation result of the exposure amount calculating unit.

3. The image forming apparatus of claim 2, wherein the density decrease calculating unit calculates the density decrease distribution in consideration of the amounts of toner consumed between the position where the toner is supplied to the developing roll and a position where the toner is supplied to each of the plurality of regions.

4. The image forming apparatus of claim 2, wherein the exposure amount calculating unit calculates an exposure amount increase distribution in consideration of a number of images to be formed continuously within one job.

5. The image forming apparatus of claim 3, wherein the exposure amount calculating unit calculates an exposure amount increase distribution in consideration of a number of images to be formed continuously within one job.

6. The image forming apparatus of claim 1, wherein the calculating unit calculates the image data amounts with the smallest unit of the image data or an accumulation of image data to be used for image formation within one job.

7. The image forming apparatus of claim 1, further comprising:

a toner image density detecting unit that detects the density of the toner image; and a toner density control unit that controls exposure amounts on the basis of the detection result of the toner image density detecting unit.

8. The image forming apparatus of claim 1, further comprising:

a density detecting unit that detects toner density inside a developing unit that visualizes the electrostatic latent image as a toner image;

a supply unit that supplies the toner to the developing unit;

a stirring unit that stirs the toner inside the developing unit; and a control unit which, when the toner density detected by the density detecting unit is lower than a predetermined target value, controls at least one of the supply unit and the stirring unit.

9. The image forming apparatus of claim 8, further comprising a detecting unit which, when the toner density detected by the density detecting unit is lower than the predetermined target value after control by the control unit, gives notification to replace a toner cartridge in which the toner is stored.

10. The image forming apparatus of claim 1, wherein the correction coefficients are set such that the correction coefficients become larger in order from the region nearest to a position where the toner is supplied to a developing roll.

11. An image density controlling method for an image forming apparatus that forms an image by two-dimensionally fast and slow-scanning and exposing with light that has been modulated in accordance with image data representing an image and visualizing an electrostatic latent image with toner, the method comprising:

dividing an image region in a fast-scanning direction into a plurality of regions;

calculating image data amounts to be used for image formation in the image data per each of the plurality of regions; and correcting, on the basis of the calculation result and each of correction coefficients in consideration of a distance between a position where the toner is supplied to a developing roll and a position where the toner is supplied to each of the plurality of regions, unevenness of density in the fast-scanning direction in the toner image, wherein the correcting step includes calculating, from the calculation result of the image data amounts and each of the correction coefficients, a density decrease distribution in the fast-scanning direction of the toner image, and wherein the density decrease calculation calculates corrected image data amount counts per each of the plurality of regions by using the correction coefficients per each of the plurality of regions and calculates the density decrease distribution in accordance with the corrected image data amount counts.

* * * * *